US008586157B2

(12) United States Patent
Dolsey

(10) Patent No.: US 8,586,157 B2
(45) Date of Patent: Nov. 19, 2013

(54) SOLVENT RESISTANT PRINTABLE SUBSTRATES AND THEIR METHODS OF MANUFACTURE AND USE

(75) Inventor: Russell Dolsey, Roswell, GA (US)

(73) Assignee: Neenah Paper, Inc., Alpharetta, GA (US)

( * ) Notice: Subject to any disclaimer, the term of this patent is extended or adjusted under 35 U.S.C. 154(b) by 133 days.

(21) Appl. No.: 13/290,471

(22) Filed: Nov. 7, 2011

(65) Prior Publication Data

US 2013/0115387 A1 May 9, 2013

(51) Int. Cl.
*B41M 5/00* (2006.01)
*B41M 5/50* (2006.01)
*B41M 5/52* (2006.01)

(52) U.S. Cl.
CPC ..... *B41M 5/506* (2013.01); *B41M 5/52* (2013.01); *B41M 5/5254* (2013.01); *B41M 5/5218* (2013.01)
USPC ..... 428/32.24; 428/32.25; 428/32.26; 428/32.34; 428/32.35; 428/32.38

(58) Field of Classification Search
CPC ..... B41M 5/506; B41M 5/52; B41M 5/5254; B41M 5/5218
USPC ..... 428/32.24, 32.25, 32.26, 32.34, 32.35, 428/32.38
See application file for complete search history.

(56) References Cited

U.S. PATENT DOCUMENTS 6,623,817 B1 * 9/2003 Yang et al. ..... 428/32.12
2002/0045035 A1 4/2002 Nojima et al.
2002/0119274 A1 * 8/2002 Yang et al. ..... 428/40.1
2003/0054145 A1 3/2003 Tokunaga et al.
2004/0161553 A1 * 8/2004 Tsubaki et al. ..... 428/32.1
2005/0089652 A1 * 4/2005 Kasahara et al. ..... 428/32.34
2006/0028527 A1 2/2006 Kaga et al.
2011/0132538 A1 6/2011 Bonney et al.
2011/0189477 A1 8/2011 Miracle et al.

FOREIGN PATENT DOCUMENTS

DE 10047157 A1 7/2001
EP 1878588 A1 1/2008
WO WO 2004/091926 A1 10/2004

OTHER PUBLICATIONS

International Search Report for corresponding PCT Application No. PCT/US2012/062921.

* cited by examiner

*Primary Examiner* — Betelhem Shewareged
(74) *Attorney, Agent, or Firm* — Dority & Manning, P.A.

(57) ABSTRACT

Printable substrates including a base sheet, a tie coating on a first surface of the base sheet, and a printable coating on the tie coating are generally provided. The tie coating can generally include a first crosslinked material formed from a film-forming binder, a first crosslinkable polymeric binder, a first crosslinking agent, and a first crosslinking catalyst. The printable coating can generally include a plurality of inorganic microparticles and a second crosslinked material formed from a second crosslinkable polymeric binder, a second crosslinking agent, and a second crosslinking catalyst. Methods of forming an image on such printable substrates are also generally provided, along with methods for forming such printable substrates.

19 Claims, 3 Drawing Sheets

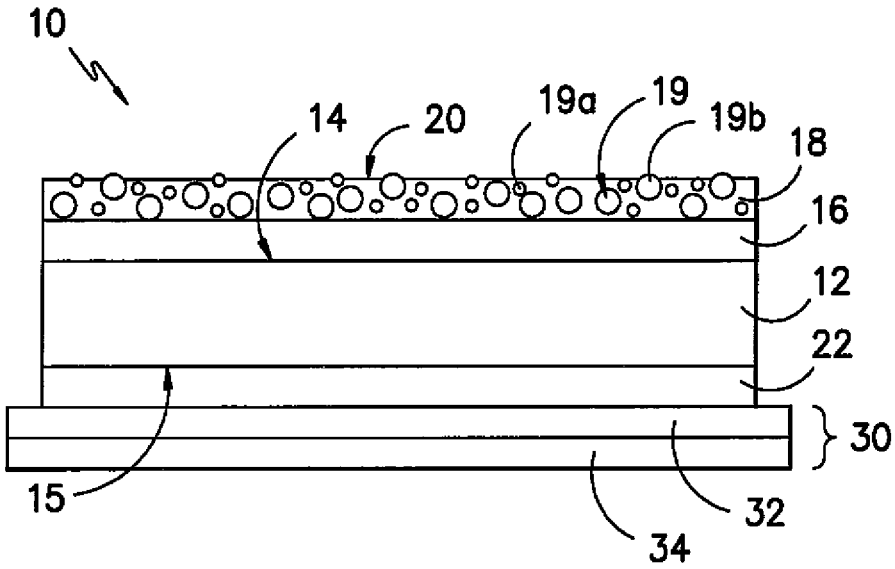
FIG. —3—
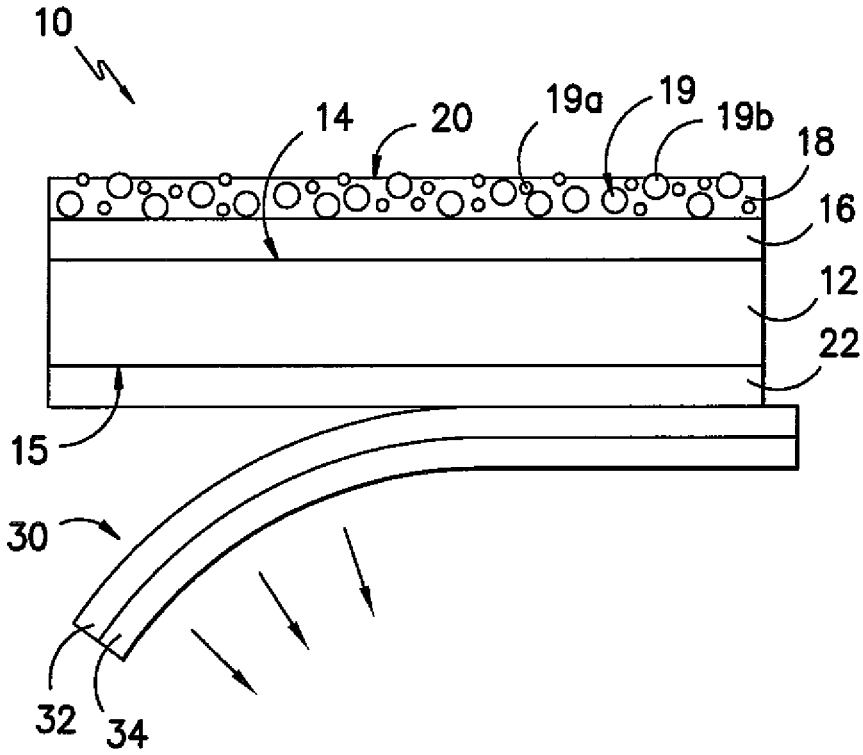
FIG. —4—

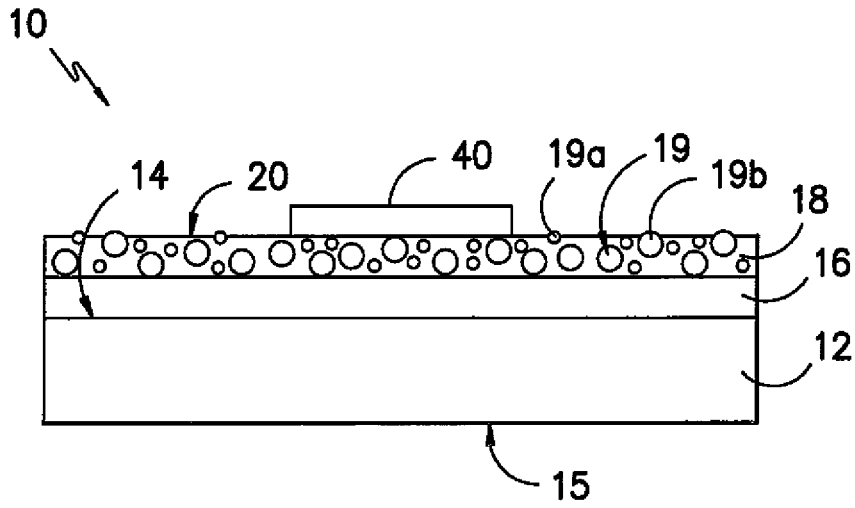
FIG. –5–
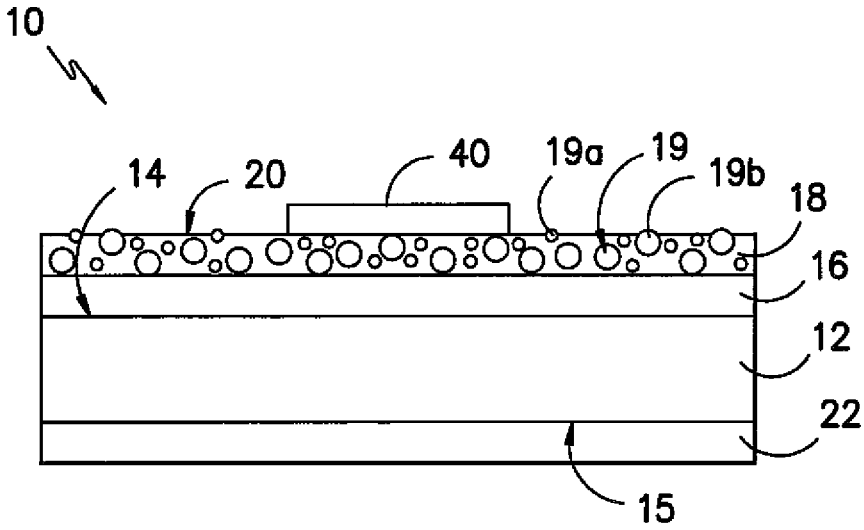
FIG. –6–

SOLVENT RESISTANT PRINTABLE SUBSTRATES AND THEIR METHODS OF MANUFACTURE AND USE

BACKGROUND OF THE INVENTION

The increased availability of printers has allowed ordinary consumers to make and print their images on a variety of papers and labels. The ink composition printed according to these processes can vary with the type of printer utilized. No matter, the inks printed onto labels can be exposed to various environments when applied to its labeled product. For example, the label can be exposed to harsh chemicals (e.g., organic solvents). This exposure to some environments can cause the ink to fade and/or be removed from the surface of the label.

Printable surfaces engineered for ink-jet printing processes are typically non-crosslinked or lightly-crosslinked polymeric layers that enable ink penetration into the printable surface during the printing process since crosslinking typically also leads to higher glass transition temperatures and less affinity of the printable layer for the ink-jet ink, leading to less durability in the printed material.

Therefore, a need exists for a substrate (e.g., a label) having improved printable characteristics and durability of printed inks on the surface of the label.

BRIEF DESCRIPTION OF THE DRAWINGS

A full and enabling disclosure of the present invention, including the best mode thereof to one skilled in the art, is set forth more particularly in the remainder of the specification, which includes reference to the accompanying figures, in which:

FIG. 3 shows the exemplary printable label substrate 10 of FIG. 2 attached to a releasable sheet 30;

FIG. 4 shows removal of the releasable sheet 30 from the exemplary printable label substrate 10 of FIG. 2 exposing the adhesive layer 22;

FIG. 5 shows an ink composition 40 applied to the exemplary printable substrate 10 of FIG. 1; and FIG. 6 shows an ink composition 40 applied to the exemplary printable substrate 10 of FIG. 2.

Figure 1:
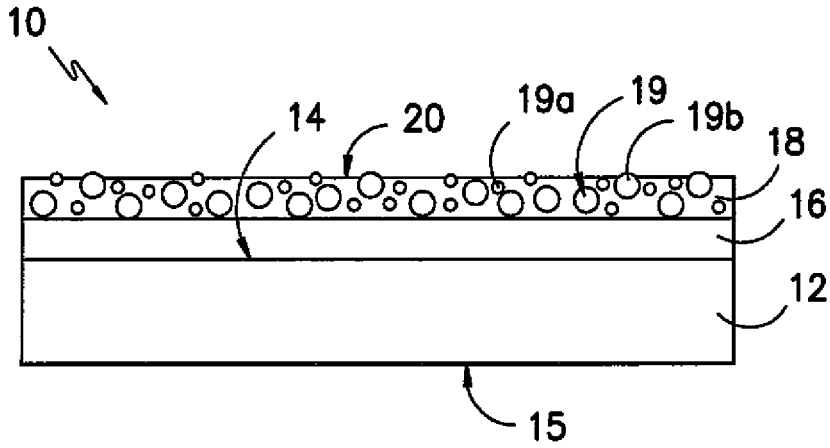
FIG. 1 shows an exemplary printable substrate 10 having a tie coating 16 and a printable coating 18 on a first surface 14 of the base sheet 12.

Repeat use of reference characters in the present specification and drawings is intended to represent the same or analogous features or elements of the present invention.

SUMMARY

Objects and advantages of the invention will be set forth in part in the following description, or may be obvious from the description, or may be learned through practice of the invention.

In general, the present disclosure is directed toward printable substrates that include a base sheet, a tie coating on a first surface of the base sheet, and a printable coating on the tie coating. The tie coating can generally include a first crosslinked material formed from a film-forming binder, a first crosslinkable polymeric binder, a first crosslinking agent, and a first crosslinking catalyst. The printable coating can generally include a plurality of inorganic microparticles and a second crosslinked material formed from a second crosslinkable polymeric binder, a second crosslinking agent, and a second crosslinking catalyst.

Methods of forming an image on such a printable substrate are also generally provided. For example, an ink composition can be printed onto the external surface of the printable substrate defined by the printable coating.

Methods are also generally provided for forming a printable substrate. In one embodiment, a tie coating precursor can be applied onto a first surface of a base sheet and cured. The tie coating precursor can generally include a film-forming binder, a first crosslinkable polymeric binder, a first crosslinking agent, and a first crosslinking catalyst. Curing the tie coating precursor on the first surface can crosslink the first crosslinkable polymeric binder and form a first crosslinked material. A printable coating precursor can then be applied on the tie coating and cured. The, printable coating precursor can generally include a plurality of inorganic microparticles, a second crosslinkable polymeric binder, a second crosslinking agent, and a second crosslinking catalyst. Curing the printable coating precursor on the first surface can crosslink the second crosslinkable polymeric binder and form a second crosslinked material.

Other features and aspects of the present invention are discussed in greater detail below.

DEFINITIONS

As used herein, the term "printable" is meant to include enabling the placement of an image on a material, especially through the use of ink-jet inks.

As used herein, the term "polymeric film" is meant to include any sheet-like polymeric material that is extruded or otherwise formed (e.g., cast) into a sheet. Typically, polymeric films do not contain discernable fibers.

As used herein, the term "polymer" generally includes, but is not limited to, homopolymers; copolymers, such as, for example, block, graft, random and alternating copolymers; and terpolymers; and blends and modifications thereof. Furthermore, unless otherwise specifically limited, the term "polymer" shall include all possible geometrical configurations of the material. These configurations include, but are not limited to isotactic, syndiotactic, and random symmetries.

The term "organic" is used herein to refer to a class of chemical compounds that are comprised of carbon atoms. For example, an "organic polymer" is a polymer that includes carbon atoms in the polymer backbone.

Chemical elements are discussed in the present disclosure using their common chemical abbreviation, such as commonly found on a periodic table of elements. For example, hydrogen is represented by its common chemical abbreviation H; helium is represented by its common chemical abbreviation He; and so forth.

As used herein, the prefix "micro" refers to the micrometer scale (i.e., from about 1 μm to about 999 μm). Particles having a size of greater than 1,000 nm (i.e., 1 micrometer or micron) are generally referred to as "microparticles", since the micrometer scale generally involves those particles having an average diameter of greater than 1 μm. In the present disclosure, when a layer is being described as "on" or "over" another layer or substrate, it is to be understood that the layers can either be directly contacting each other or have another layer or feature between the layers, unless otherwise stated. Thus, these terms are simply describing the relative position of the layers to each other and do not necessarily mean "on top of" since the relative position above or below depends upon the orientation of the device to the viewer.

DETAILED DESCRIPTION

Reference now will be made to the embodiments of the invention, one or more examples of which are set forth below. Each example is provided by way of an explanation of the invention, not as a limitation of the invention. In fact, it will be apparent to those skilled in the art that various modifications and variations can be made in the invention without departing from the scope or spirit of the invention. For instance, features illustrated or described as one embodiment can be used on another embodiment to yield still a further embodiment. Thus, it is intended that the present invention cover such modifications and variations as come within the scope of the appended claims and their equivalents. It is to be understood by one of ordinary skill in the art that the present discussion is a description of exemplary embodiments only, and is not intended as limiting the broader aspects of the present invention, which broader aspects are embodied exemplary constructions.

Generally speaking, the present invention is directed to printable substrates (e.g., printable label substrates) that exhibit good durability with respect to an ink-jet printing(s) on the printable substrate, even in harsh environments such as exposure to organic solvents, etc. Additionally, the print quality formed on the coated label substrates can be of excellent quality such that virtually any image can be printed on the substrates.

In particular, the printable substrates include a base sheet having at least two coatings on one of its surfaces: a tie coating and a printable coating. Generally, the tie coating is positioned between the base sheet and the printable coating. Referring to FIG. 1, an exemplary printable substrate 10 having a tie coating 16 and a printable coating 18 over a first surface 14 of a base sheet 12 is generally shown. The tie coating 16 and the printable coating 18 are positioned such that the tie coating 16 is between the printable coating 18 and the base sheet 12 to allow the printable coating 18 to define an exterior surface 20 of the printable substrate 10.

The tie coating 16 and the printable coating 18 can generally be highly crosslinked materials to form a printable substrate 10 that is solvent resistant, especially to those organic solvents that may otherwise solubilize the binder in the print coating if not crosslinked. Without wishing to be bound by any particular theory, it is believed that the tie coating 16 and the printable coating 18 work in combination, with both layers heavily crosslinked, to yield a highly solvent resistant surface that remains printable by conventional printing processes, including ink-jet printing.

I. Printable Coating

The printable coating can generally be applied to the base sheet (i.e., on the tie coating) in order to form an external, printable surface on the resulting printable substrate. Specifically, the printable coating can improve the printability of the label substrate. Additionally, any printing on the printable coating can be durable and can withstand harsh conditions (e.g., exposure to moisture and/or harsh chemical environments) and can exhibit an increased scratch and abrasion resistance.

The printable coating can act as an anchor to hold the printed image (e.g., formed by a ink-jet based ink) on the coated label substrate. Thus, the printed substrate can have increased durability in a variety of environments. In one particular embodiment, the print coating can provide a solvent resistant printable surface, particularly for organic solvents such as alcohols, kerosene, toluene, xylenes (e.g., a mixture of the three isomers of dimethylbenzene), benzene, oils, etc.

The printable coating, in one particular embodiment, includes a plurality of inorganic microparticles 19 and a crosslinked material formed from a crosslinkable polymeric binder, a crosslinking agent, and a crosslinking catalyst. For example, the printable coating can comprise about 60% by weight to about 80% by weight of the inorganic microparticles (e.g., about 65% by weight to about 75% by weight), about 15% by weight to about 30% by weight of the crosslinkable polymeric binder (e.g., about 17% by weight to about 25% by weight), about 1% by weight to about 10% by weight of the crosslinking agent (e.g., about 3% by weight to about 8% by weight), and about 0.1% by weight to about 2% by weight of the crosslinking catalyst (e.g., about 0.1% by weight to about 1% by weight). Each of these components is discussed in greater detail below.

The inorganic microparticle 19 can be, in one particular embodiment, a metal-oxide microparticle, such as silicon dioxide ($SiO_2$), aluminum oxide ($Al_2O_3$), aluminum dioxide ($AlO_2$), zinc oxide (ZnO), and combinations thereof. Without wishing to be bound by theory, it is believed that the inorganic microparticles 19 add affinity for the inks of the printed image to the printable coating. For example, it is believed that the metal-oxide porous microparticles (e.g., $SiO_2$) can absorb the ink liquid (e.g., water and/or other solvents) quickly and can retain the ink molecules upon drying, even after exposure to an organic solvent. Additionally, it is believe that metal-oxide microparticles (e.g., $SiO_2$) can add an available bonding site at the oxide that can bond (covalent bonds or ionic bonds) and/or interact (e.g., van der Waals forces, hydrogen bonding, etc.) with the ink binder and/or pigment molecules in the ink. This bonding and/or interaction between molecules of the ink composition and the oxide of the microparticles can improve the durability of the ink printed on the printable surface.

The inorganic microparticles 19 can have an average diameter on the micrometer (micron or μm) scale, such as from about 4 μm to about 17 μm (e.g., about 7 μm to about 15 μm). Such microparticles can provide a sufficiently large surface area to interact with the ink composition applied to the printable coating 18, while remaining sufficiently smooth on the exposed surface 20. Additionally, microparticles that are too large can lead to grainy images formed on the printable coating 18 and/or reduce the sharpness of any image applied thereto.

In one particular embodiment, the printable coating can include a first plurality of inorganic microparticles **19*a* having a first average diameter and a second plurality of inorganic microparticles 19*b* having a second average diameter, with the first average diameter being smaller than the second average diameter. For example, the first average diameter can be about 5 μm to about 12 μm (e.g., about 7 to about 11), and the second average diameter can be about 10 μm to about 15 μm (e.g., about 11 to about 14). In this embodiment, the first plurality (having smaller average diameters) can help the sharpness of any images applied to the printable coating 18, while the second plurality (having larger average diameters) can help to quickly absorb the ink into the printable coating 18**.

In one particular embodiment, a higher weight percent of the first plurality of inorganic microparticles **19*a* (having smaller average diameters) can be present in the layer than the second plurality of inorganic microparticles 19*b* (having larger average diameters). It is believed, without wishing to be bound by any particular theory, that such a ratio of particles 19** can allow the crosslinkable polymeric binder to form a stronger coating through its ability to better hold the smaller particles than the larger particles. Additionally, it is believed that the larger particles can help speed up the intake and/or drying times of the ink (to prevent bleeding).

As stated, a crosslinking agent and a curing agent are present in the printable coating 18 to ensure that a highly crosslinked coating is formed. In particular, the crosslinkable polymeric binder can react with the crosslinking agent to form a 3-dimensional crosslinked material around the microparticles 19 to hold and secure the microparticles 19 in place in the printable coating 18.

Generally, it is contemplated that any pair of crosslinkable polymeric binder and crosslinking agent that reacts to form the 3-dimensional polymeric structure may be utilized. Particularly suitable crosslinking polymeric binders include those that contain reactive carboxyl groups. Exemplary crosslinking binders that include carboxyl groups include acrylics, polyurethanes, ethylene-acrylic acid copolymers, and so forth. Other desirable crosslinking binders include those that contain reactive hydroxyl groups. Cross-linking agents that can be used to crosslink binders having carboxyl groups include polyfunctional aziridines, epoxy resins, carbodiimide, oxazoline functional polymers, and so forth. Cross-linking agents that can be used to crosslink binders having hydroxyl groups include melamine-formaldehyde, urea formaldehyde, amine-epichlorohydrin, multi-functional isocyanates, and so forth.

In one particular embodiment, the crosslinkable polymeric material can be an ethylene acrylic acid copolymer, such as available under as Michem Prime 4983 (Michelman), and the crosslinking agent can be an epoxy crosslinking agent, such as available under the name CR-5L (Esprix Technologies, Sarasota, Fla.).

A crosslinking catalyst can also be present in the printable coating 18 to help ensure sufficient crosslinking occurs during curing. For example, the crosslinking catalyst can be an imidazole curing agent.

When the printable coating 18 is directed to applications for receiving a dye-based ink via ink-jet printing, the printable coating can further include a cationic polyelectrolyte, such as the low molecular weight, high charge density cationic polyelectrolyte available under the name GLASCOL F207 (BASF). When present, the printable coating can include about 1% by weight to about 5% by weight of the cationic polyelectrolyte.

Other additives, such as processing agents, may also be present in the printable coating, including, but not limited to, thickeners, dispersants, emulsifiers, viscosity modifiers, humectants, pH modifiers etc. Surfactants can also be present in the printable coating to help stabilize the emulsion prior to and during application. For instance, the surfactant(s) can be present in the printable coating up to about 5%, such as from about 0.1% to about 1%, based upon the weight of the dried coating. Exemplary surfactants can include nonionic surfactants, such as a nonionic surfactant having a hydrophilic polyethylene oxide group (on average it has 9.5 ethylene oxide units) and a hydrocarbon lipophilic or hydrophobic group (e.g., 4-(1,1,3,3-tetramethylbutyl)-phenyl), such as available commercially as Triton® X-100 from Rohm & Haas Co, of Philadelphia, Pa. In one particular embodiment, a combination of at least two surfactants can be present in the printable coating.

Viscosity modifiers can be present in the printable coating. Viscosity modifiers are useful to control the rheology of the coatings in their application. For example, sodium polyacrylate (such as Paragum 265 from Para-Chem Southern, Inc., Simpsonville, S.C.) may be included in the printable coating. The viscosity modifier can be included in any amount, such as up to about 5% by weight, such as about 0.1% to about 1% by weight.

Additionally, pigments and other coloring agents may be present in the printable coating such that the printable coating provides a background color to the printable substrate. For example, the printable coating may further include an opacifier with a particle size and density well suited for light scattering (e.g., aluminum oxide particles, titanium oxide particles, and the like). These opacifiers may be additional metal-oxide particles within the polymer matrix of the printable coating. These opacifiers can be present in the printable coating from about 0.1% by weight to about 25% by weight, such as from about 1% by weight to about 10% by weight.

When it is desired to have a relatively clear or transparent printable coating, the printable coating can be substantially free from pigments, opacifying agents, and other coloring agents (e.g., free from metal particles, metalized particles, clay particles, etc.) other than the inorganic microparticles. In these embodiments, the underlying base sheet can be seen through the printable coating, except where an image is printed on the printable coating.

The printable coating may be applied to the label substrate by known coating techniques, such as by roll, blade, Meyer rod, and air-knife coating procedures. Alternatively, the printable coating may be a film laminated to the base sheet. The resulting printable substrate then may be dried by means of, for example, steam-heated drums, air impingement, radiant heating, or some combination thereof. The printable coating can, in one particular embodiment, be formed by applying a polymeric emulsion onto the tie coating on the surface of the base sheet, followed by drying. Likewise, an adhesive layer, when present, may be applied to the opposite surface of the base sheet by any technique.

In one particular embodiment, the printable coating 18 can be formed by applying a printable coating precursor on the tie coating 16, where the printable coating precursor includes the plurality of inorganic microparticles, the crosslinkable polymeric binder, the crosslinking agent, and the crosslinking catalyst. The printable coating precursor can then be dried and cured on the tie coating to crosslink the crosslinkable polymeric binder. While some heat may be applied to dry the precursor (i.e., enough heat to remove water and any other solvents), heat is not necessary for curing in particular embodiments. As such, curing can be achieved at room temperature (e.g., about 20° C. to about 25° C.). However, applying heat for curing may increase the time required for curing of the coating.

The basis weight of the printable coating generally may vary from about 2 to about 70 g/m$^2$, such as from about 3 to about 50 g/m$^2$. In particular embodiments, the basis weight of the printable coating may vary from about 5 to about 40 g/m$^2$, such as from about 7 to about 25 g/m$^2$.

II. Tie Coating

As stated, the tie coating 16 and the printable coating 18 can be positioned such that the tie coating 16 is between the printable coating 18 and the base sheet 12. As such, the tie coating 16 can help adhere and otherwise secure the printable coating 18 to the first surface 14 of the base sheet 12.

The tie coating, in one embodiment, includes a crosslinked material formed from a film-forming binder, a crosslinkable polymeric binder, a crosslinking agent, and a crosslinking catalyst. For example, the tie coating can comprise about 50% by weight to about 75% by weight of the film-forming binder (e.g., about 60% by weight to about 70% by weight), about 15% by weight to about 40% by weight of the crosslinkable polymeric binder (e.g., about 17% by weight to about 25% by weight), about 5% by weight to about 15% by weight of the crosslinking agent (e.g., about 6% by weight to about 10% by weight), and about 0.1% by weight to about 2% by weight of the crosslinking catalyst (e.g., about 0.1% by weight to about 1% by weight).

The film forming binder and the crosslinkable polymeric binder are stated separately since both binders are generally included in most embodiments of the tie coating as separate binder compositions with differing chemistries. However, in one embodiment, the film forming binder and the crosslinkable polymeric binder can be identical. No matter their composition, the total binder composition (i.e., the sum of the film-forming binder and the crosslinkable polymeric binder) can be about 75% to about 95% by weight of the tie coating, such as about 80% to about 93% by weight.

In general, any film-forming binder may be employed. In one particular embodiment, the film-forming binder can be "polar" in nature. Differences in polarity between two substances (such as a polymer and a solvent) are directly responsible for the different degrees of intermolecular stickiness from one substance to another. For instance, substances that have similar polarities will generally be soluble or miscible in each other but increasing deviations in polarity will make solubility increasingly difficult. Without wishing to be bound by theory, it is believed that if the binder used in the tie coating 16 is more polar, the tie coating can adhere better and with more durability to the base sheet 12 (particularly, when formed from a polymeric film) and/or the printable coating 18.

In general, any polar film-forming binder can be utilized in the tie coating 16. In one embodiment, polymers containing carboxy groups can be utilized. The presence of carboxy groups can readily increase the polarity and solubility parameter of a polymer because of the dipole created by the oxygen atom. For example, in some embodiments, carboxylated (carboxy-containing) polyacrylates can be used as the acrylic latex binder. Also, other carboxy-containing polymers can be used, including carboxylated nitrile-butadiene copolymers, carboxylated styrene-butadiene copolymers, carboxylated ethylene-vinylacetate copolymers, and carboxylated polyurethanes. Also, in some embodiments, a combination of polar film-forming binders can be utilized within the tie coating 16.

In one embodiment, the polar film-forming binder can be an acrylic latex binder. Suitable polyacrylic latex binders can include polymethacrylates, poly(acrylic acid), poly(methacrylic acid), and copolymers of the various acrylate and methacrylate esters and the free acids; ethylene-acrylate copolymers; vinyl acetate-acrylate copolymers, and the like. Suitable acrylic latex polymers that can be utilized as the film forming binder include those acrylic latexes sold under the trade names Rhoplex SP-100 by Rohm and Haas (Wilmington, Del.) and/or HYCAR® by Noveon, Inc. (Cleveland, Ohio).

The polar film forming binder can be, in another embodiment, a polyurethane, such as a water-borne polyurethane. For instance, the polyurethane may be a polyesterpolyurethane-based resin that includes a polyesterpolyol obtained by esterifying dicarboxylic acid and a diol component, and polyisocyanate. A chain extension agent may be included, if desired. In some embodiments, the polyesterpolyurethane-based resin may be copolymerized with hydroxycarboxylic acid, etc. such as p-hydroxy benzoic acid, etc. in addition to containing the dicarboxylic acid component and the diol component. Moreover, although these have a linear structure, branching polyester may be made using ester-forming components of trivalent or more.

Examples of the dicarboxylic acid component in the polyesterpolyurethane-based resin include terephthalic acid, isophthalic acid, 2,6-naphthalene dicarboxylic acid, adipic acid, trimethyladipic acid, sebacic acid, malonic acid, dimethylmalonic acid, succinic acid, glutaric acid, pimelic acid, 2,2-dimethylglutaric acid, azelaic acid, fumaric acid, maleic acid, itaconic acid, 1,3-cyclopentane dicarboxylic acid, 1,2-cyclohexane dicarboxylic acid, 1,4-cyclohexane dicarboxylic acid, 1,4-naphthalic acid, diphenic acid, 4,4'-hydroxybenzoic acid, and 2,5-naphthalene dicarboxylic acid, etc.

Examples of the diol component in the polyesterpolyurethane-based resin include aliphatic glycols such as ethylene glycol, 1,4-butanediol, diethylene glycol, and triethylene glycol; aromatic diols such as 1,4-cyclohexane dimethanol; and poly(oxyalkylene)glycols such as polyethylene glycol, polypropylene glycol, and polytetramethylene glycol, etc.

Examples of polyisocyanate include hexamethylene diisocyanate, diphenylmethane diisocyanate, tolylene diisocyanate, isophorone diisocyanate, tetramethylene diisocyanate, xylylene diisocyanate, lysine diisocyanate, an adduct of tolylene diisocyanate and trimethylolpropane, and an adduct of hexamethylene diisocyanate and trimethylolethane, etc.

Examples of the chain extension agent include pendant-carboxyl-group-containing diols; glycols such as ethylene glycol, diethylene glycol, propylene glycol, 1,4-butanediol, hexamethylene glycol, and neopentyl glycol; and diamines such as ethylenediamine, propylenediamine, hexamethylenediamine, phenylenediamine, tolylenediamine, diphenyldiamine, diaminodiphenylmethane, diaminodiphenylmethane, and diaminocyclohexylmethane, etc.

The crosslinkable polymeric binder, the crosslinking agent, and the crosslinking catalyst can be selected from those discussed above with respect to the printable coating 18. Although it is not required that the same material be used for each of the crosslinkable polymeric binder, the crosslinking agent, and/or the crosslinking catalyst, in one embodiment, the crosslinkable polymeric binder, the crosslinking agent, and/or the crosslinking catalyst can be identical in both the tie coating 16 and the printable coating 18.

Other additives, such as processing agents, may also be present in the tie coating, including, but not limited to, thickeners, dispersants, emulsifiers, viscosity modifiers, humectants, pH modifiers, etc. Such additional additives are discussed above with respect to the printable coating 18.

In one embodiment, the tie coating 16 can be formed by applying a tie coating precursor onto the first surface 14 of a base sheet 12, wherein the tie coating precursor comprises the film-forming binder, the crosslinkable polymeric binder, the crosslinking agent, and the crosslinking catalyst. The tie coating precursor can then be dried and cured to crosslink the film-forming binder and the crosslinkable polymeric binder forming a crosslinked material on the first surface. While some heat may be applied to dry the precursor (i.e., enough heat to remove water and any other solvents), heat is not necessary for curing in particular embodiments. As such, curing can be achieved at room temperature (e.g., about 20° C. to about 25° C.). However, applying heat for curing may decrease the time required for curing of the coating.

The basis weight of the tie coating generally may vary from about 2 to about 50 g/m$^2$, such as from about 3 to about 25 g/m$^2$. In particular embodiments, the basis weight of the tie coating may vary from about 4 to about 15 g/m$^2$, such as from about 5 to about 10 g/m$^2$.

III. Printable Substrates

Figure 2:
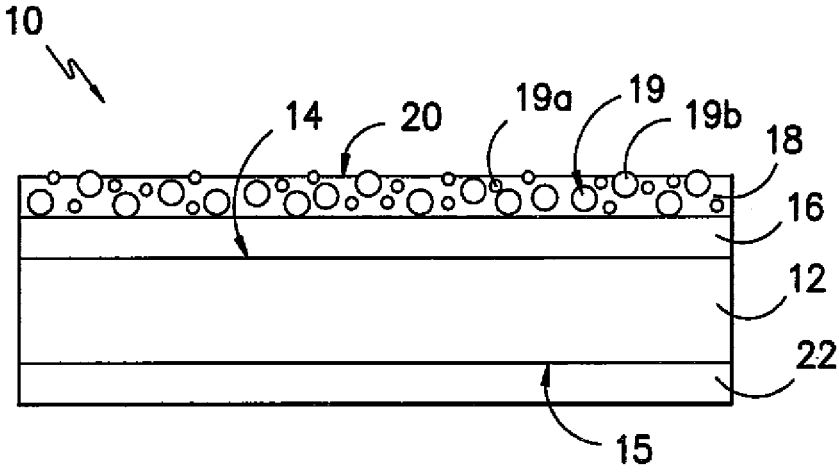
FIG. 2 shows an exemplary printable label substrate 10 having a tie coating 16 and a printable coating 18 on a first surface 14 of the base sheet 12 and an adhesive layer 22 on the opposite surface of the base sheet (i.e., the second surface 15)

FIG. 1 shows an exemplary printable substrate 10 having a printable coating 18 as described above. The printable coating 18 defines an external, printable surface 20 of the printable substrate 10. The printable coating 18 is shown overlying the tie coating 16 on the first surface 14 of the base sheet 12. In the embodiment of FIG. 2, an adhesive layer 22 is shown overlying the opposite, second surface 15 of the base sheet 12. Although shown with an adhesive layer 22 in FIG. 2, the printable substrate 10 can employ any available connector to attach the coated label substrate to the material/product to be labeled. Other suitable connectors include, for example, ties (e.g., wires, cords, strings, ropes, and the like), tape (e.g., the use of tape to secure the label substrate to the product), etc.

The tie coating 16 is shown in the exemplary embodiment of FIG. 1 as directly overlying the first surface 14 of the base sheet 12 (Le., no intermediate layer exists between the first surface 14 of the base sheet 12 and the tie coating 16). Likewise, the adhesive layer 22 is shown in the exemplary embodiment of FIG. 2 as directly overlying the second surface 15 of the base sheet 12 (i.e., no intermediate layer exists between the second surface 15 of the base sheet 12 and the adhesive layer 22). In other embodiments, however, an intermediate layer(s) could be present between the base sheet 12 and the tie coating 16 and/or between the base sheet 12 and the adhesive layer 22. For example, a second tie coating may be present between the base sheet 12 and the adhesive layer 22.

The base sheet is generally flexible and has first and second surfaces. For example, the label substrate can be a film or a cellulosic nonwoven web. In addition to flexibility, the base sheet also provides strength for handling, coating, sheeting, and other operations associated with the manufacture thereof. The basis weight of the label substrate generally may vary, such as from about 30 to about 250 g/m$^2$. Suitable base sheet include, but are not limited to, cellulosic nonwoven webs and polymeric films.

The adhesive layer 22 can be a pressure sensitive adhesive, a glue applied or wet adhesive, or any other type of suitable adhesive material. For example, the adhesive layer can include natural rubber, styrene-butadiene copolymers, acrylic polymers, vinyl-acetate polymers, ethylene vinyl-acetate copolymers, and the like.

FIGS. 3 and 4 show a releasable sheet 30 can be attached to the printable substrate 10 to protect the adhesive layer 22 until the printable substrate 10 is to be applied to its final surface. The releasable sheet 30 includes a release layer 32 overlying a base sheet 34. The release layer 32 allows the releasable sheet 30 to be released from the printable substrate 10 to expose the adhesive layer 22 such that the printable substrate 10 can be adhered to its final surface via the adhesive layer 22.

The base sheet 34 of the releasable sheet 30 can be any film or web (e.g., a paper web). For example, the base sheet 34 can be generally manufactured from any of the materials described above with regards to the label substrate.

The release layer 32 is generally included to facilitate the release of the releasable sheet 30 from the adhesive layer 22. The release layer 32 can be fabricated from a wide variety of materials well known in the art of making peelable labels, masking tapes, etc. Although shown as two separate layers in FIGS. 3-4, the release layer 32 can be incorporated within the base sheet 34, so that they appear to be one layer having release properties.

To apply the label to a surface, the releasable sheet is first separated from the coated label substrate to expose the adhesive layer of the coated label substrate. The releasable sheet can be discarded and the coated label substrate can be adhered to a surface via the adhesive layer.

IV. Printing onto the Printable Coating of the Printable Substrate

An image can be formed on the printable coating of the coating label substrate by printing an ink composition onto the printable coating. In particular, ink-jet printing methods can print the ink composition to the printable coating. Ink-jet inks can typically be pigment based inks (e.g., Durabrite® inks by Epson), dye-based inks (e.g., Cairia® inks by Epson), water-based inks that are sublimation inks sensitive to heat but are still classified as dyes (e.g., such as available from Sawgrass Technology).

FIGS. 5-6 show an ink composition 40 on the printable coating 18 of the printable substrate 10. The ink composition can form any desired image desired on the printable coating. Typically, the composition of the ink composition will vary with the printing process utilized, as is well known in the art.

The present invention may be better understood with reference to the following examples.

EXAMPLES

The following commercially available materials were used as bought in the Examples described herein:

Rhoplex SP-100 (Rohm and Haas, Wilmington, Del.) is an acrylic latex.

Triton X-100 (Dow Chemical Company, Midland, Mich.) is a non-ionic surfactant.

Paragum 265 (Para-Chem Southern, Inc., Simpsonville, S.C.) is sodium polyacrylate useful as a thickener.

GLASCOL F207 is a low molecular weight, high charge density cationic polyelectrolyte, comprising an aqueous solution of a poly(dimethyl diallylammonium chloride) homopolymer, believed to be (2-Propen-1-aminium, N,N-dimethyl-N-2-propenyl-, chloride, homopolymer) available from BASF.

IMICURE AMI-2 is imidazole curing agent available from Air Products.

Michem Prime 4983 is an ethylene acrylic acid copolymer available from Michelman.

Rhoplex SP 100 is an acrylic latex available from Rohm and Haas.

CR-5L is an epoxy crosslinking agent available from Esprix Technologies (Sarasota, Fla.).

TERGITOL 15-S-40 is a secondary alcohol ethoxylate nonionic surfactant available from Dow Chemical Company (Midland, Mich.).

SYLOID 74 is powdered silica particles having a particle size of 8.1 μm to 9.5 μm available from Grace Davison, W. R. Grace & Co. (Connecticut).

SYLOID 620 is powdered silica particles having a particle size of about 11.5 μm to about 13.5 μm available from Grace Davison, W. R. Grace & Co. (Connecticut).

Working examples of printable substrates were formed on the following base sheets with the following tie coating and printable coatings:

Base Sheets:

The following tie coating and printable coatings were applied onto polypropylene films, polyethylene films, and a laminate having a center core of polypropylene and outer shell of polyethylene.

Tie Coating:

A tie coating precursor was made by mixing water, Triton X-100, Rhoplex SP-100, Michem 4983R, ammonia, CR-5L, and Imicure AMI-2. After curing and drying, the tie coating included 0.9% by weight Triton X-100, 66.8% by weight Rhoplex SP-100, 22.3% by weight Michem 4983R, 0.9% by weight ammonia, 8.9% by weight CR-5L, and 0.3% by weight Imicure AMI-2, based on the total dry weight of the tie coating.

Printable Coating 1: A printable coating precursor was made by mixing water, Tergitol 15-S-40, Syloid 620, Syloid 74, Triton X-100, ammonia, Michem 4983R, CR-5L, Imicure AMI-2, and Paragum 265. After curing and drying, the printable coating included 1.4% by weight Tergitol 15-S-40, 17.6% by weight Syloid 620, 52.9% by weight Syloid 74, 0.7% by weight Triton X-100, 0.7% by weight ammonia, 21.2% by weight Michem 4983R, 4.5% by weight CR-5L, 0.2% by weight Imicure AMI-2, and 0.4% by weight Paragum 265, based on the total weight of the printable coating.

Printable Coating 2:

A printable coating precursor was made by mixing water, Tergitol 15-S-40, Syloid 620, Syloid 74, Triton X-100, ammonia, Glascol F-207, Michem 4983R, CR-5L, Imicure AMI-2, and Paragum 265. After curing and drying, the printable coating included 1.4% by weight Tergitol 15-S-40, 17.0% by weight Syloid 620, 61.1% by weight Syloid 74, 0.7% by weight Triton X-100, 0.7% by weight ammonia, 3.4% by weight Glascol F-207, 20.4% by weight Michem 4983R, 4.8% by weight CR-5L, 0.2% by weight Imicure AMI-2, and 0.3% by weight Paragum 265, based on the total weight of the printable coating.

Example 1

Each of the exemplary printable coatings (1 and 2) in combination with the exemplary tie coating were tested on each of the base sheets in the presence of various solvents in a Sutherland Rub Tester Model 2000 at 2 lbs. weight using a Muslin fabric brand Kona Premium—Kaufman White 100% cotton fabric saturated with the test solvent and rubbed 999 times on speed cycle 4 (approximately 9.5 minutes). The following were used as the test solvents: isopropyl alcohol (100%), betadine, warm soapy water (32° C.) formed from Dial® antibacterial hand soap sku#017000 072272, Purell® hand sanitizer (65% ethyl alcohol), epsom salt solution (15% solids), body wash (Aveno® Body wash, sku#38137-0036463), methanol (100%), xylene (100%), Zep Fast 505 ® cleaner, 409® cleaner, kerosene, automotive brake fluid, hydraulic oil (ProMix® AW-32), automotive anti-freeze at room temp. (approximately 40% ethylene glycol and 60% water), and methyl ethyl ketone (100%).

Each of the exemplary printable coatings was rated after the rub resistance test. Each rendered excellent rub resistance ratings (i.e., without even minor scratching or print and/or loss of coating) in the presence of each of the solvents in the rub tester.

Example 2

Each of the exemplary printable coatings (1 and 2) in combination with the exemplary tie coating were made on each of the base sheets with varying amounts of crosslinker in the tie coating and the printable coating. Samples were made according to Table 1 and printed with Espon B500, a pigmented ink called Durabrite at a printer setting of Text and Images/presentation Matte, and dried at 55° C. for 5 minutes prior to solvent testing:

TABLE 1

| | Sample | | | | | | | |
|---|---|---|---|---|---|---|---|---|
| | A | B | C | D | E | F | G | H |
| wt. % of crosslinker in the tie coating | 9% | 0% | 5% | 5% | 0% | 9% | 9% | 9% |
| wt. % of crosslinker in the printable coating | 7% | 4% | 4% | 7% | 7% | 0% | 4% | 8% |
| Rub Rating | 5 | 3 | 3 | 3 | 3 | 4 | 4 | 5 |
| Tape Peel Rating | 5 | 1 | 2 | 3 | 3 | 5 | 3 | 5 |

The rub rating was on a scale of 1-5, with 5 being the best rub resistance, according to the procedure explained above and using xylene (100%) as the solvent. Specifically, a rating of 5 indicated excellent rub resistance; a rating of 4 indicated good rub resistance with some scratching or print or loss of coating but not major; a rating of 3 indicated fair rub resistance; a rating of 2 indicated major scratching and/or print loss of the coating; and a rating of 1 indicates that large areas of print and/or coating was removed during testing. As seen in Table 1, a high level of crosslinker in the tie coating and the printable coating (as in Samples A and H) achieved the best rub resistance results.

Each of the samples was also subjected to a tape peel test, where a 4.5 pound roller 2½" wide was rolled 10 passes over Scotch 3M 810 1" tape. Tape was then pulled quickly at a 90° angle to the printing. A rating of 5 indicated excellent peel resistance with very little print coat removed and the print still legible; a rating of 4 being good peel resistance with a little loss of print coat but still legible; a rating of 3 being fair peel resistance; a rating of 2 being less than fair peel resistance; and a rating of 1 being poor peel resistance where the printable coating was removed cleanly from base sheet and/or from tie coating and the print was no longer legible. As seen in Table 1, a high level of crosslinker in the tie coating and the printable coating (as in Samples A and H) achieved the best peel resistance results.

These and other modifications and variations to the present invention may be practiced by those of ordinary skill in the art, without departing from the spirit and scope of the present invention, which is more particularly set forth in the appended claims. In addition, it should be understood the aspects of the various embodiments may be interchanged both in whole or in part. Furthermore, those of ordinary skill in the art will appreciate that the foregoing description is by way of example only, and is not intended to limit the invention so further described in the appended claims.

What is claimed:

1. A printable substrate comprising a base sheet defining a first surface and a second surface;

a tie coating on the first surface of the base sheet, wherein the tie coating comprises first crosslinked material formed from a film-forming binder, a first crosslinkable polymeric binder, a first crosslinking agent, and a first crosslinking catalyst; and a printable coating on the tie coating, wherein the printable coating comprises a plurality of inorganic microparticles and a second crosslinked material formed from a second crosslinkable polymeric binder, a second crosslinking agent, and a second crosslinking catalyst.

2. The printable substrate as in claim 1, wherein the film-forming binder comprises an acrylic latex, the first polymeric binder comprises an ethylene acrylic polymer, the first crosslinking agent comprises an epoxy crosslinking agent, and the first crosslinking catalyst comprises an imidazole curing agent.

3. The printable substrate as in claim 1, wherein the inorganic microparticles comprise silicon dioxide microparticles.

4. The printable substrate as in claim 1, wherein the inorganic microparticles have an average diameter of from about 4 μm to about 17 μm.

5. The printable substrate as in claim 1, wherein the printable coating comprises a first plurality of inorganic microparticles having a first average diameter and a second plurality of inorganic microparticles having a second average diameter, wherein the first average diameter is smaller than the second average diameter.

6. The printable substrate as in claim 5, wherein the first average diameter is about 7 μm to about 11 μm, and wherein the second average diameter is about 11 μm to about 14 μm.

7. The printable substrate as in claim 1, wherein the second crosslinkable polymeric binder comprises an ethylene acrylic polymer, the second crosslinking agent comprises an epoxy crosslinking agent, and the second crosslinking catalyst comprises an imidazole curing agent.

8. The printable substrate as claim 1, wherein the tie coating comprises about 50% by weight to about 75% by weight of the film-forming binder, about 15% by weight to about 40% by weight of the first crosslinkable polymeric binder, about 5% by weight to about 15% by weight of the first crosslinking agent, and about 0.1% by weight to about 2% by weight of the first crosslinking catalyst.

9. The printable substrate as in claim 1, wherein the printable coating comprises about 60% by weight to about 80% by weight of the inorganic microparticles, about 15% by weight to about 30% by weight of the second crosslinkable polymeric binder, about 1% by weight to about 10% by weight of the second crosslinking agent, and about 0.1% by weight to about 2% by weight of the second crosslinking catalyst.

10. The printable substrate as in claim 1, wherein the printable coating further comprises a cationic polyelectrolyte.

11. The printable substrate as claim 10, wherein the printable coating comprises about 1% by weight to about 5% by weight of the cationic polyelectrolyte.

12. The printable substrate as in claim 1, wherein the tie coating has a basis weight of about 5 to about 10 g/m2, and wherein the printable coating has a basis weight of about 7 g/m2 to about 25 g/m2.

13. The printable substrate as in claim 1, wherein the base sheet comprises a polymeric film.

14. The printable substrate as in claim 1, further comprising an ink composition applied to an external surface of the coated label substrate formed by the printable coating, wherein the ink composition defines an image on the external surface.

15. The printable substrate as in claim 14, wherein the ink composition comprises an ink-jet ink.

16. The printable substrate as in claim 1, wherein the printable coating directly overlies the tie coating without any intermediate layer present between the printable coating and the tie coating, and wherein the tie coating directly overlies the first surface of the base sheet without any intermediate layer present between the tie coating and the first surface.

17. The printable substrate as in claim 1, further comprising:

a connector configured to attach the printable substrate to a product for labeling.

18. The printable substrate as in claim 17, wherein the connector is an adhesive layer overlying the second surface of the base sheet.

19. The printable substrate as in claim 1, wherein the printable coating defines an external surface of the printable substrate.

* * * * *